United States Patent [19]

Coppens

[11] Patent Number: 4,848,968

[45] Date of Patent: Jul. 18, 1989

[54] STABILIZATION SYSTEM

[75] Inventor: Anton Coppens, RP Oegstgeest, Netherlands

[73] Assignee: Heerema Engineering Services BV, Leiden, Netherlands

[21] Appl. No.: 155,367

[22] Filed: Feb. 12, 1988

[30] Foreign Application Priority Data

Feb. 12, 1987 [GB] United Kingdom ..... 8703221

[51] Int. Cl.[4] ..... B63B 35/44

[52] U.S. Cl. ..... 405/204; 405/195

[58] Field of Search ..... 405/195, 209, 204, 224, 405/203, 208; 114/265, 264, 293; 212/190, 196, 191

[56] References Cited

U.S. PATENT DOCUMENTS

| | | | |
|---|---|---|---|
| 3,378,086 | 4/1968 | Kivisild | 405/224 X |
| 3,919,957 | 11/1975 | RAy et al. | 405/224 X |
| 3,934,528 | 1/1976 | Horton et al. | 405/224 X |
| 4,048,945 | 9/1977 | Shrum | 405/224 X |

*Primary Examiner*—Dennis L. Taylor

*Attorney, Agent, or Firm*—Fulwider, Patton, Rieber, Lee & Utecht

[57] ABSTRACT

A method of stabilizing a floating body comprises applying to the body a vertical force so as to maintain the body in an equilibrium position which is spaced vertically from the normal floating position of the body, in which the vertical force comprises a limited vertical force applying means acting on the body in one vertical direction and a flexible tension member applying tension to the body or the force applying means in the opposite vertical direction, the tension member having a tension less than the said limited vertical force.

18 Claims, 14 Drawing Sheets

STABILIZATION SYSTEM

This invention relates to a method and apparatus for stabilizing a floating body.

BACKGROUND TO THE INVENTION

It is known to use ballast tanks in vessels for stabilization of pitch and roll motions of the vessel. It is also known to use anchor lines or tension leg systems for positioning and dynamic stabilization of vessels. Severe strain can be put on the vessel by use of such tension lines, however, if the vessel experiences high wave-induced motions and damage may result.

BRIEF SUMMARY OF THE INVENTION

According to the present invention there is provided a method of stabilizing a floating body, which comprises applying to the body a vertical force so as to maintain the body in an equilibrium position which is spaced vertically from the normal floating position of the body, in which the vertical force comprises a limited vertical force applying means acting on the body in one vertical direction and a flexible tension member applying tension to the body or the force applying means in the opposite vertical direction, the tension member having a tension less than the said limited vertical force.

The invention also provides apparatus for stabilizing a floating body, comprising means to apply a vertical force to the body so as to maintain the body in an equilibrium position which is spaced vertically from the normal floating position of the body, said means comprising a limited vertical force applying means acting on the body in one vertical direction and a flexible tension member applying tension to the body or the force applying means in the opposite vertical direction, the tension member having a tension less than the said limited vertical force.

By way of example, some embodiments of the invention will now be described with reference to the accompanying drawings.

DESCRIPTION OF THE PREFERRED EMBODIMENTS

Figure 1:
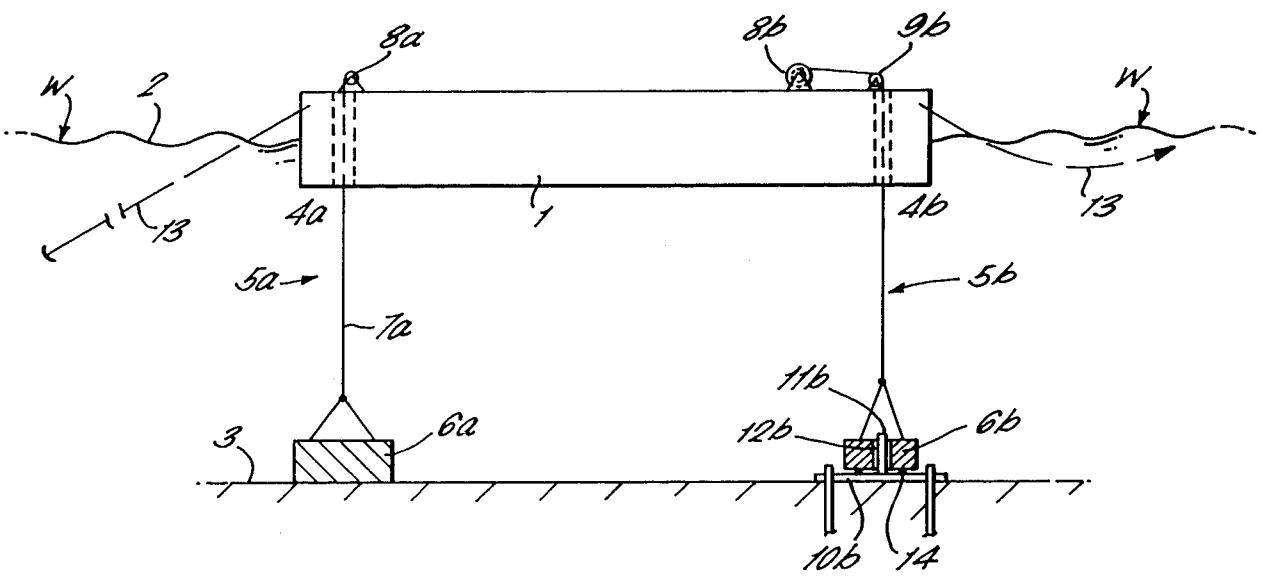
FIG. 1 shows one form of vessel stabilization system.

In FIG. 1 there is seen a floating body 1 which may, for example, be a barge. The body 1 has a positive buoyancy and may be a semi-submersible or submerged vessel. The surface of the water is indicated by 2 and the sea bed by 3. At sides or corners 4*a*, 4*b*, the body 1 is provided with stabilization control devices 5*a*, 5*b*. The control devices 5*a*, 5*b* comprise clump weights 6*a*, 6*b* which are suspended from the body 1 via flexible tension members 7*a*, 7*b* controlled by winches 8*a*, 8*b*. Clump weights 6*a*, 6*b* provide downward forces to act on the body 1. The flexible tension members 7*a*, 7*b* may be cables, wires, chains or the like i.e., be capable of transmitting a force by tension in the tension member, but not capable of transmitting on opposite force. Here, winch 8*a* incorporates a brake. Tension member 7*b* feeds from winch 8*b* over a pulley 9*b* having a stopper, e.g. chain. Clump weights 6*a*, 6*b* are engageable with surfaces remote from the body 1. Clump weight 6*a* is simply engageable directly with the sea bed 3. Clump weight 6*b* is engageable with the surface of a piled foundation or gravity base 10*b* on the sea bed 3. The base 10*b* includes a guide for lateral location of the clump weight 6*b* relative to the seabed. Here, the guide is in the form of an upstanding shaft 11*b* slidably engaging a hole 12*b* in the clump weight 6*b*. In addition, the base 10*b* includes snubber means 14 to absorb impacts of the clump weight 6*b*. Additional tugger lines and/or mooring lines 13 may be provided for the body 1.

The system is adjusted so that in the equilibrium position of the body 1, the clump weights 6*a*, 6*b* are partially resting on the sea bed, i.e., the tension in the tension members 7*a*, 7*b* is less than the full weight of the clump weights. Adjustment of the system may be realized by ballasting/deballasting the vessel and/or control of winches 8*a*, 8*b*. The equilibrium position of the body in this embodiment is the position at which the body floats in still waters with the clump weights partially resting on their engagement surfaces, and this is below the normal floating position of the body.

The control devices 5*a*, 5*b* serve as dynamic stabilizers for the body 1 by means of motion induced counter forces. When waves W induce roll or heave motions in the body 1, the corners 4*a*, 4*b* of the body move up and down. If a corner 4*a*, 4*b* of the body 1 moves down, it will be seen that the effect is to reduce the tension in the tension member 7*a*, 7*b* at that corner 4*a*, 4*b* as more of the weight of the clump weight 6*a*, 6*b* at that corner is taken by the sea bed, i.e., the downward force on the body 1 at that corner is reduced. If a corner 4*a*, 4*b* of the body 1 moves up, less of the weight of the clump weight 6*a*, 6*b* at that corner is taken by the sea bed 3 and there is more tension in the tension member 7*a*, 7*b* at that corner 4*a*, 4*b*, i.e., the downward force on the body 1 at that corner is increased. It will be seen that the tension in the tension members 7*a*, 7*b* can vary between theoretical limits of zero, when the clump weights 6*a*, 6*b* are fully supported by the sea bed, and the full weight of the clump weights 6*a*, 6*b*, when the clump weights separate from the sea bed. In practice, the size of the clump weights 6*a*, 6*b* is desirably chosen to suit the expected amplitudes of vertical motion of the body 1 so that the clump weights are not completely lifted up or set down. The elasticity in the tension members 7*a*, 7*b* and snubber means 14 ensures that the clump weights 6*a*, 6*b* are not completely lifted up or set down for small vertical displacements of the body 1. The body 1 may be provided with only a single stabilization control device, but this would only be able to control wave induced heave motions, i.e. vertical motions of one point on the vessel. Preferably, therefore, the body 1 is provided with control devices at a number of horizontally spaced locations, e.g. at each side or corner of the body, so that wave induced roll motions as well as heave motions are stabilized.

Figure 2:
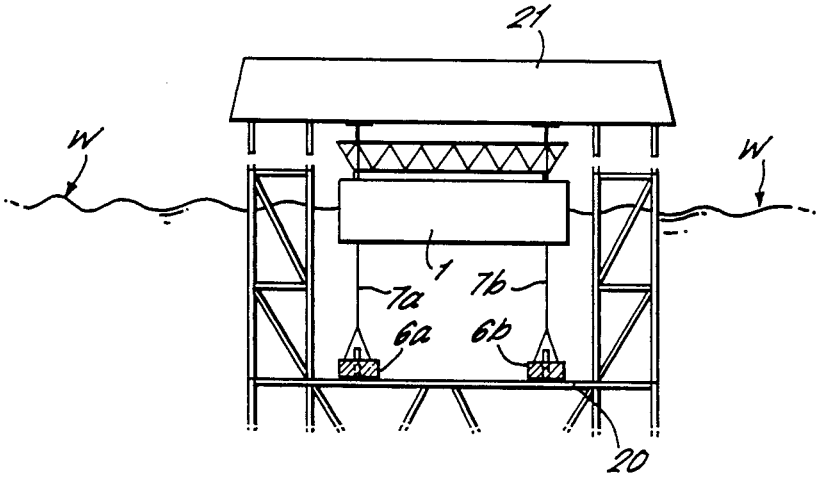
FIG. 2 shows the stabilization system for a vessel installing a module on a platform jacket.

In FIG. 2 there is seen a variation of the system shown in FIG. 1. Here, the clump weights 6*a*, 6*b* are engageable with surfaces on a fixed offshore structure 20, such as the platform jacket shown. The body 1 here is an installation vessel for setting down or removing a module 21 from the platform jacket 20. The clump weights 6*a*, 6*b* are located laterally by means of guides on the platform jacket 20, in similar fashion to the stabilization control device 5*b* described above. Here, to maintain the required tension it is necessary to be able control the length of the tension members 7*a*, 7*b* in order to compensate for ballasting/deballasting of the vessel 1 during transfer of the module 21.

Figure 3:
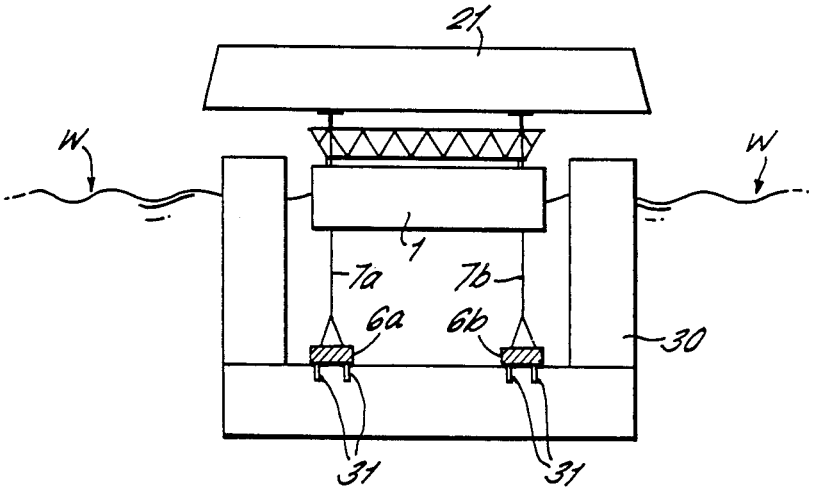
FIG. 3 shows the stabilization system for a vessel installing a module on a semi-submersible.

In FIG. 3 there is seen another variation of the system shown in FIGS. 1 and 2. Here, the clump weights 6*a*, 6*b* are engageable with surfaces on a separate floating body 30, in this case a semi-submersible. The body 1 here is again an installation vessel for transferring a module 21. The clump weights 6*a*, 6*b* are again located laterally relative to the semi-submersible 30 by means of guides. Here, the guides are in the form of stabbing pins 31 which extend downwardly from the clump weights 6*a*, 6*b* and which are engageable in holes in the semi-submersible. Here again, to maintain the required tension it is necessary to be able to control the length of tension members 7*a*, 7*b* to compensate for ballasting/deballasting of the vessel 1 during transfer of the module 21.

Figure 4:
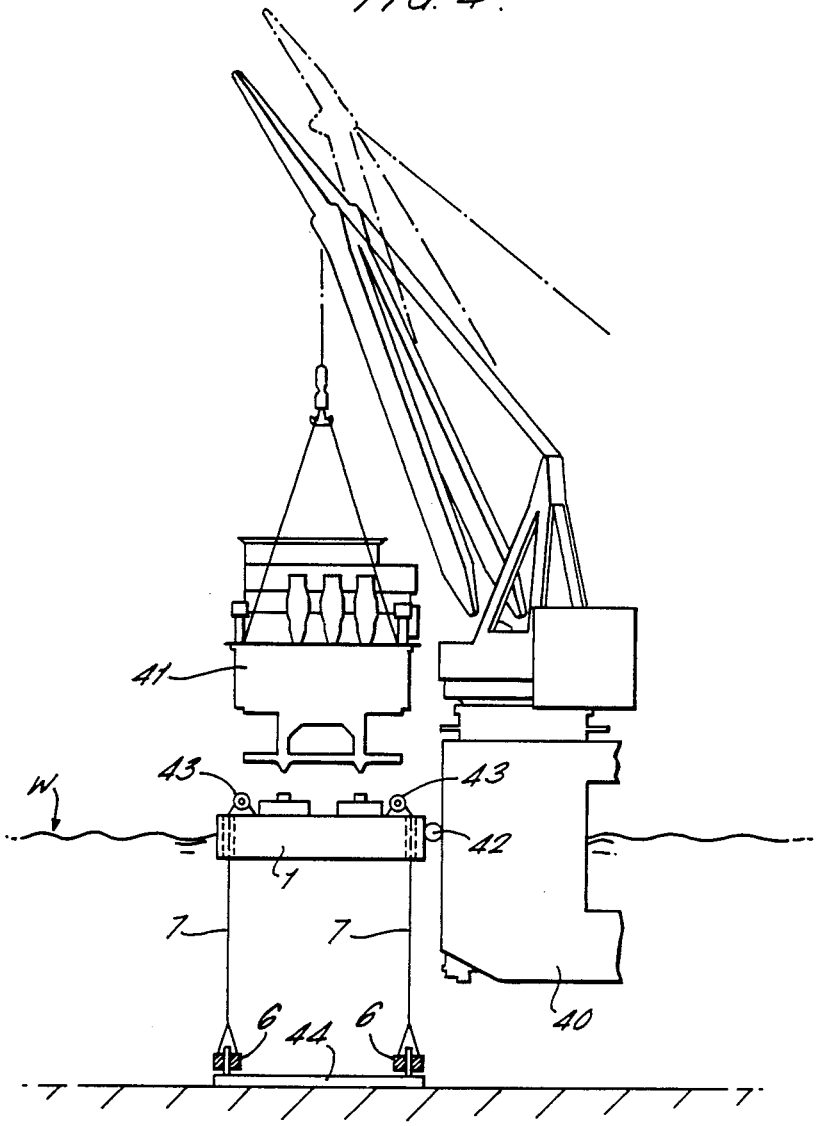
FIGS. 4 and 5 show a crane vessel carrying a module to and from a stabilized cargo barge.
Figure 5:
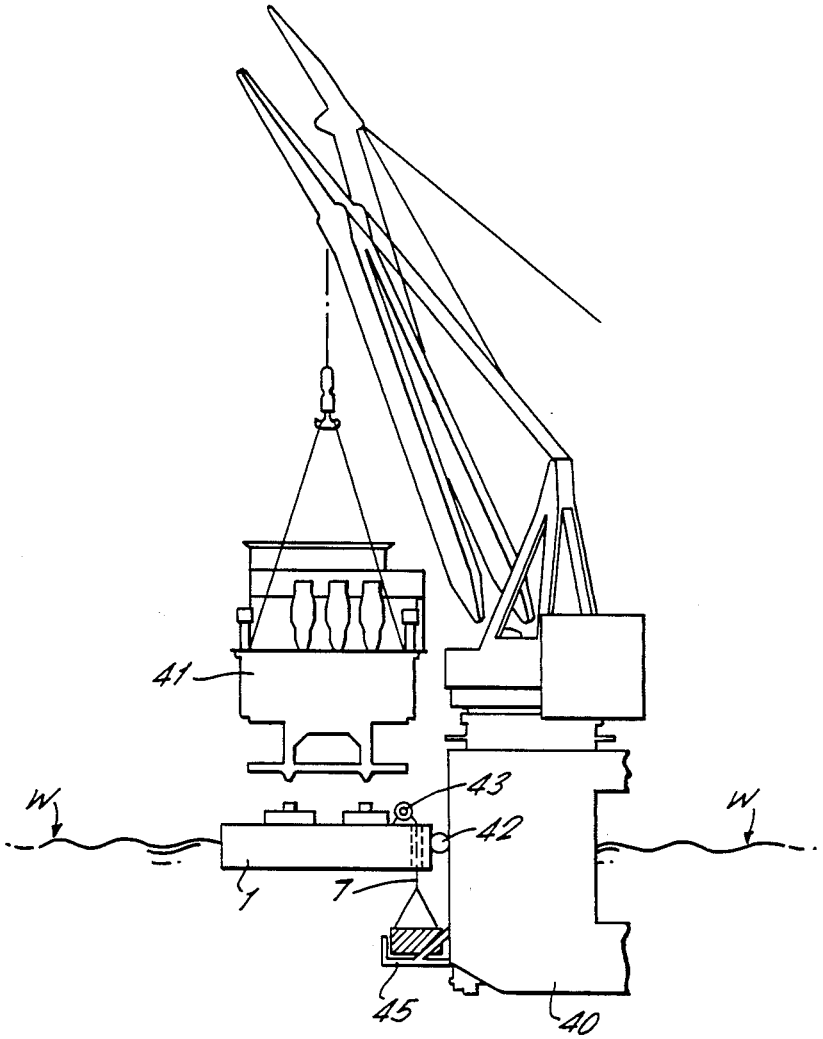

FIGS. 4 and 5 show examples of the stabilization system in use on cargo barge 1 with a semi-submersible crane vessel 40 transfering a module 41. A fender 42 is interposed between the cargo barge 1 and crane vessel 40. Winches 43 control tension members 7. Clump weights 6 in FIG. 4 are engageable on the surface of a base unit 44 on the sea bed. The base unit 44 has guides for lateral location of the clump weights 6. Clump weights 6 in FIG. 5 are engageable on the surface of a purpose built bracket 45 on the crane vessel 40. Guides are preferably also included for lateral location of the clump weights 6 relative to the crane vessel 40. The winches 43 are controlled as necessary to adjust the length of the tension members 7 during transfer of the module 41 to maintain the required tension. Control of the winches 43 may be realized manually or by computer to keep the tension within required limits.

Figure 6:
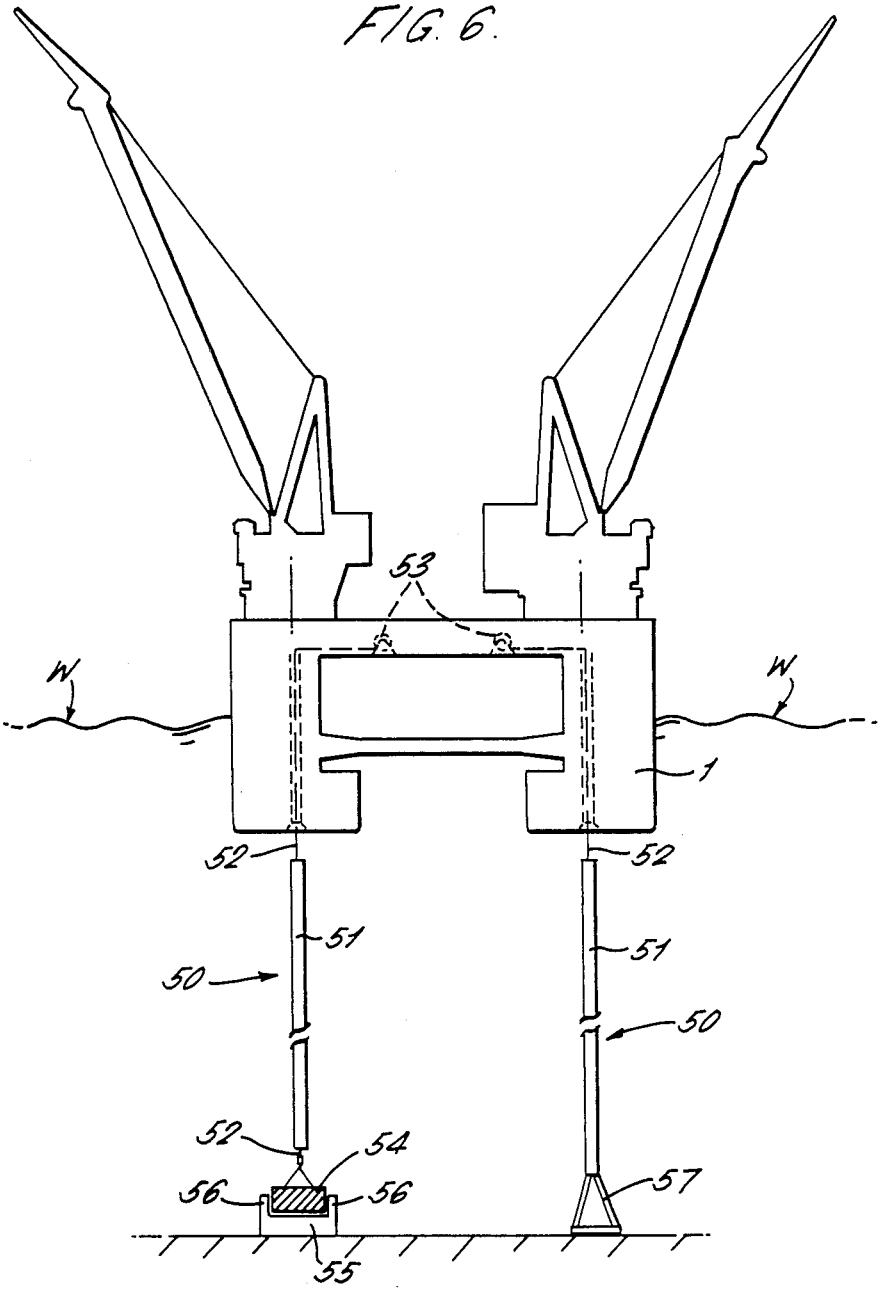
FIGS. 6 and 7 show a modification to the stabilization system of FIG. 1.
Figure 7:
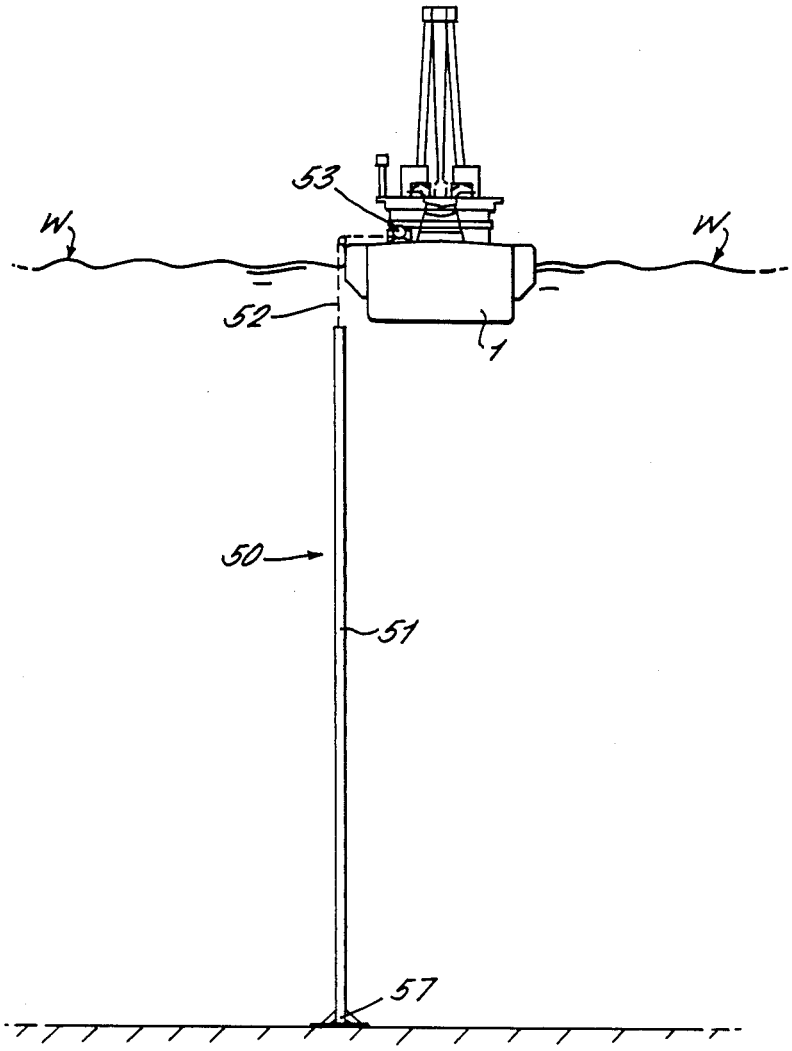

In FIGS. 6 and 7 there is seen a modification to the stabilization control device. Here, the tension members 50 include a section 51 which is relatively inelastic. The section 51 may for example be a riser pipe or tube, i.e. have considerably greater stiffness than a chain, cable, wire or the like 52 which makes up the remainder of the tension member 50. This increased stiffness is necessary in deeper water to avoid too high strain in the tension members 50 so that the motions of the vessel 1 are not stopped or reduced. The stiffness of the tension members must be higher than the hydrostatic stiffness of the vessel. Again, winches 53 are provided to control adjustment of the tension members 50 as necessary to maintain the required tension. In FIG. 6 there is seen a clump weight 54 which is engageable with the surface of a gravity base 55 on the sea bed, and which is located laterally by guide means 56 on the gravity base. In FIG. 7 and also in FIG. 6 there is seen an alternative, which is a weighted cone 57 at the base of the riser 51 engageable on the sea bed.

Figure 8:
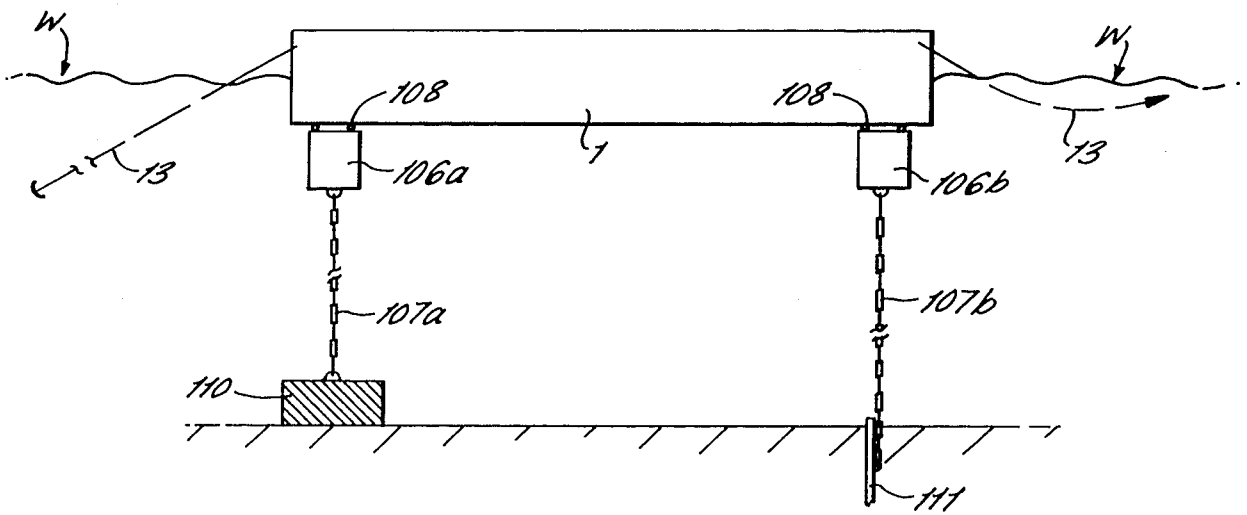
FIG. 8 shows another form of vessel stabilization system.

In FIG. 8 there is seen an alternative form of vessel stabilization system. Again, body 1 has a positive buoyancy. Here, buoyancy tanks 106*a*, 106*b* are held by flexible tension members 107*a*, 107*b* to be engageable with surfaces beneath the floating body 1.

Buoyancy tanks 106*a* provide upward forces to act on body 1. The tension members 107*a*, 107*b* may again be cables, lines, chains or the like as described earlier and be anchored to the sea bed by a gravity base 110, for example, or a piled anchor 111. Snubber means 108 are preferably provided to absorb impacts between the body 1 and buoyancy tanks 106*a*, 106*b*. Again, additional tugger lines and/or mooring lines 13 may be provided for the body 1. Here, no winches are needed to control the tension members 107*a*, 107*b*. Instead, the necessary tension is maintained by controlling as necessary the draft of the body 1, i.e. by ballasting and deballasting the body. It will be seen that the upthrust from the buoyancy tanks 106*a*, 106*b* on the body 1 can be adjusted between theoretical limits of zero, when the body 1 separates from the buoyancy tanks and the full upthrust of the buoyancy tanks, when there is zero tension in the tension members 107*a*, 107*b*. The system is arranged so that in the equilibrium position of the body, the upthrust on the body from the buoyancy tanks is less than the buoyancy force of the tanks. Here, the equilibrium position of the body will be spaced above the normal floating position of the body. As in the previous system, in practice the buoyancy tanks are preferably arranged to be able to compensate for wave induced body motions without reaching the limits of tension. A single control device can stabilize vertical motions of only one point on the body and therefore a number of such devices are preferably provided at various locations, e.g. at each side or corner of the body. In this way, wave induced pitch and roll motions of the body as well as heave motions can be stabilized. It will be appreciated that tension members 107*a*, 107*b* may be anchored to a fixed structure, instead of the sea bed as shown in FIG. 8.

Figure 9:
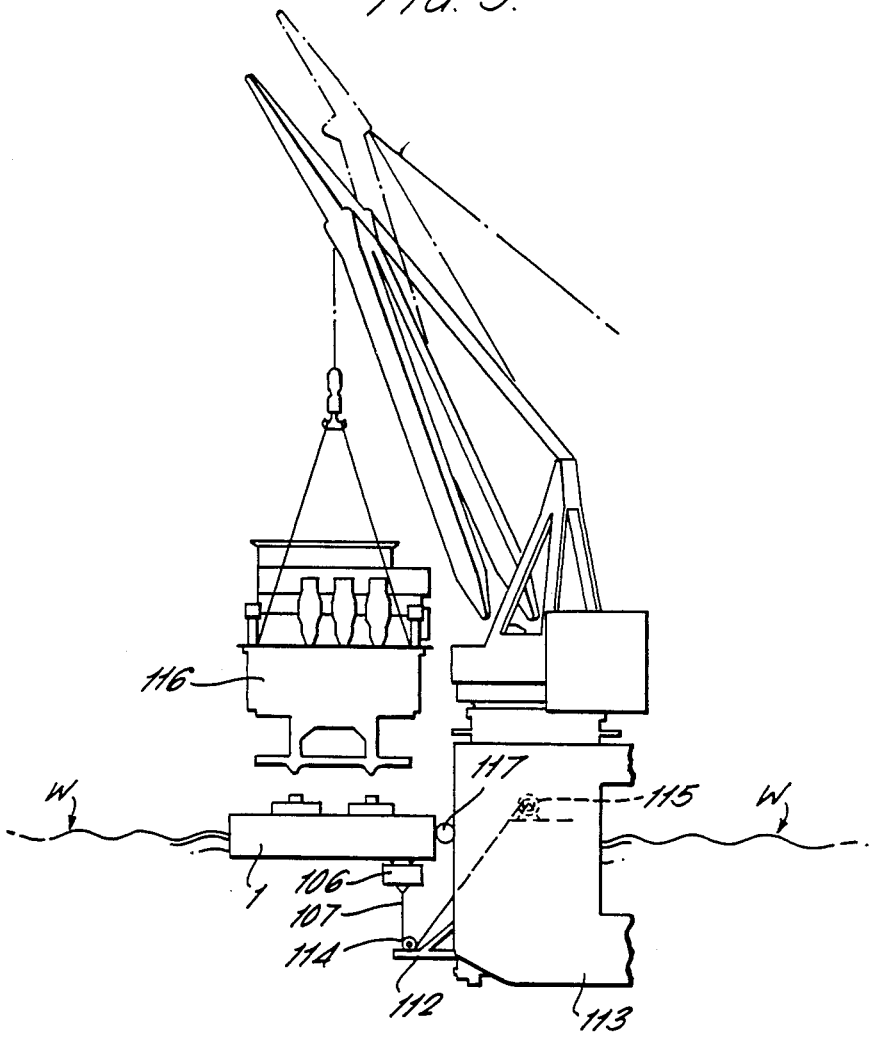
FIG. 9 shows a crane vessel carrying a module to and from a stabilized cargo barge.

In FIG. 9 there is seen a modification of the alternative form of stabilization system of FIG. 8. Here, the buoyancy tank 106 is held by tension member 107 to a purpose built bracket 112 on another floating body 113, which in this case is a crane vessel for transferring a module 116. The tension member 107 passes under a pulley 114 on the bracket 112 and to a winch 115. The necessary tension in the tension member 107 to stabilize body 1 is maintained by adjusting the winch 115 and/or ballasting/deballasting the body 1. A fender 117 is interposed between the body 1, which here is a cargo barge, and the crane vessel 113.

Figure 10:
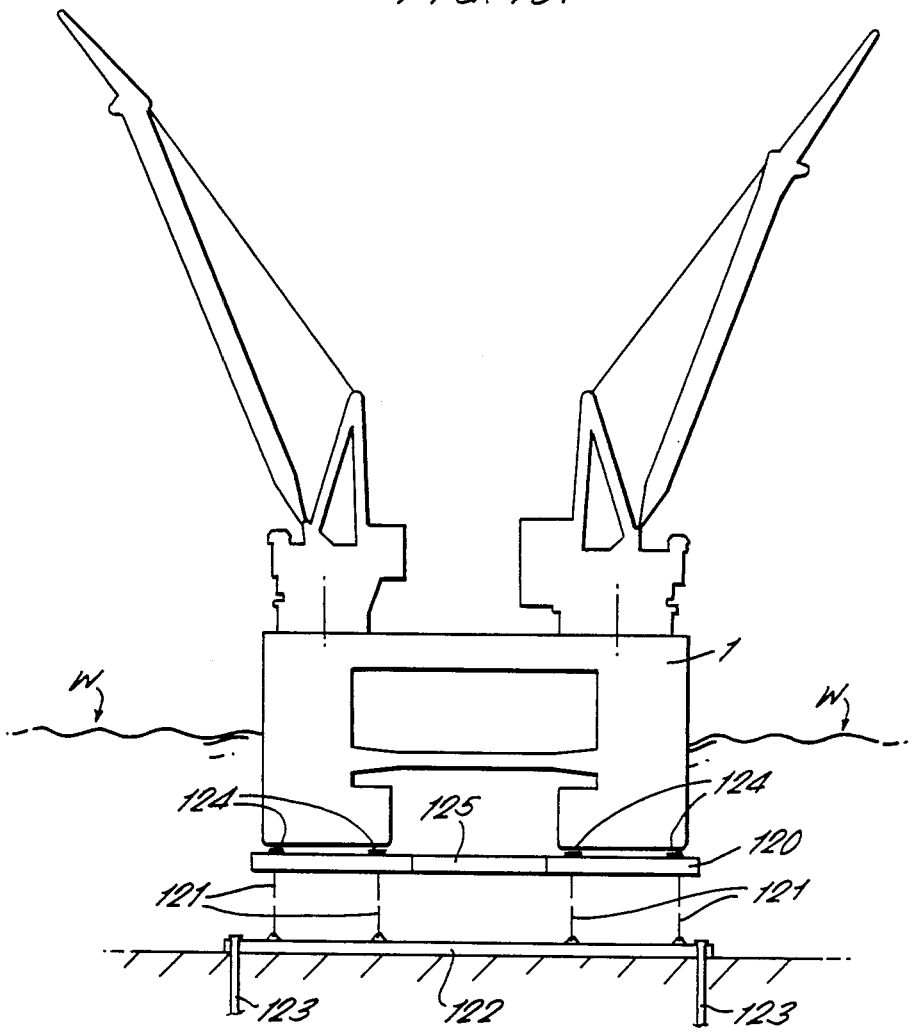
FIG. 10 shows a modification to the stabilization system of FIG. 8.

In FIG. 10 there is seen another modification in which a single float 120 is used. The float 120 is anchored by tension members 121 to a base unit 122 which is fixed to the sea bed by piles 123. Snubber means 124 are interposed between the body 1 and float 120 to absorb impact forces. Openings 125 are preferably provided in the float 120 to reduce wave loading. The required tension in the tension members 121, i.e. giving the necessary degree of upthrust on the body 1, is controlled by adjusting the draft of the body 1 by ballasting/deballasting the body.

Figure 11:
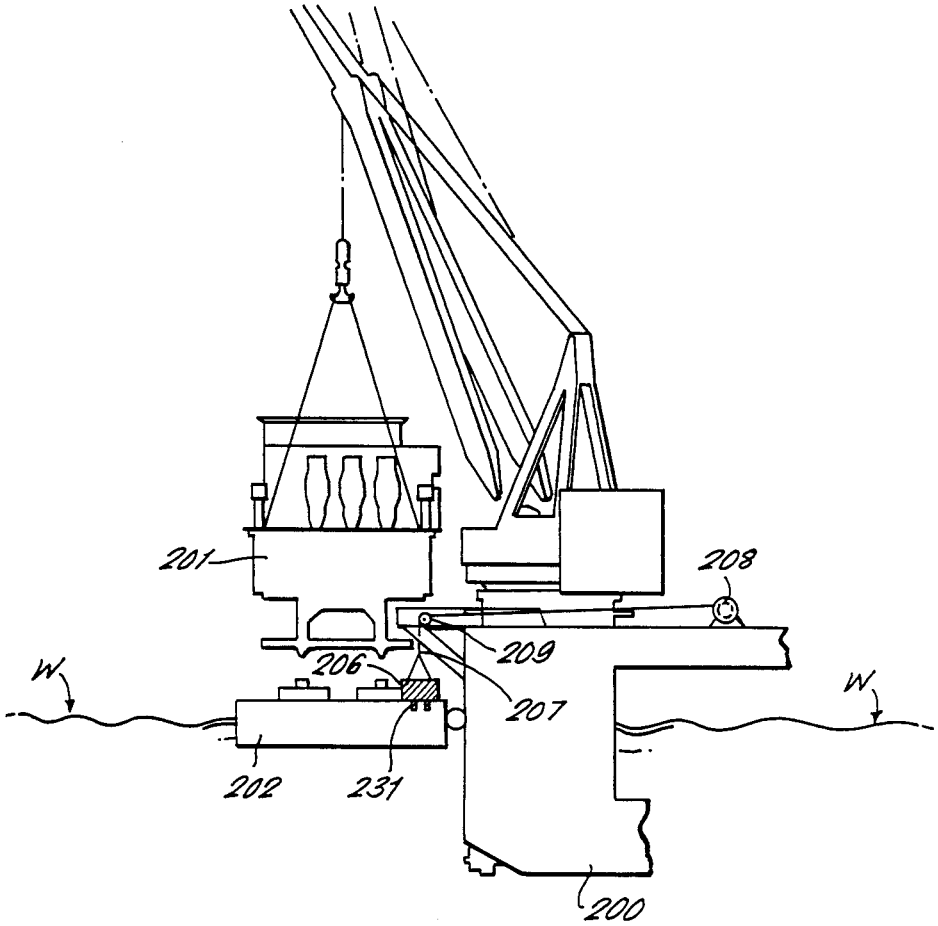
FIG. 11 shows a crane vessel carrying a module to and from a stabilized cargo barge.

In FIG. 11 there is seen a crane vessel 200 transfering a module 201 to or from a stabilized cargo barge 202. The cargo barge 202 is stabilized by means of a clump weight 206 which is engageable with the deck of the barge. Stabbing pins 231 on the clump weight 206 are engageable in suitable holes on the barge to provide lateral location for the clump weight relative to the barge. The clump weight 206 is suspended by a tension member 207, e.g. chain, cable, wire etc. passing over a pulley 209 to a winch 208. The magnitude of the downward force exerted on the barge 202 by the clump weight 206 is controlled by adjusting winch 208 and/or ballasting/deballasting barge 208 during lifting or setting of module 201. As in the previously described stabilization systems, it will be seen here that upward or downward movement of the barge 202 automatically gives rise to an opposed, counterbalancing force from the clump weight, the magnitude of which force is governed by the tension in the tension member.

Figure 12:
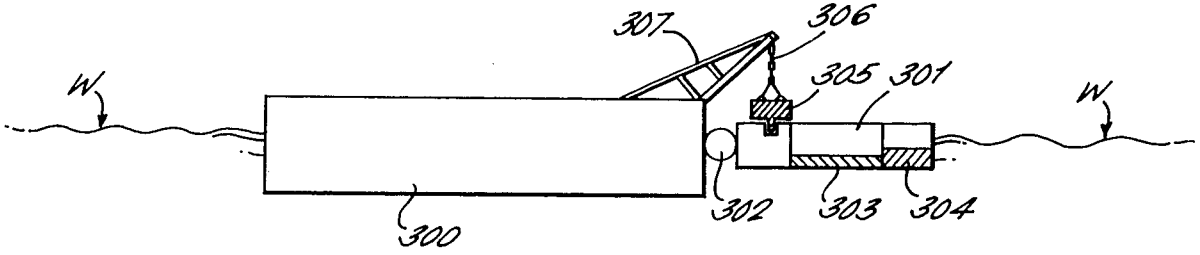
FIGS. 12 and 13 show end and plan views respectively of another form of vessel stabilization system.
Figure 13:
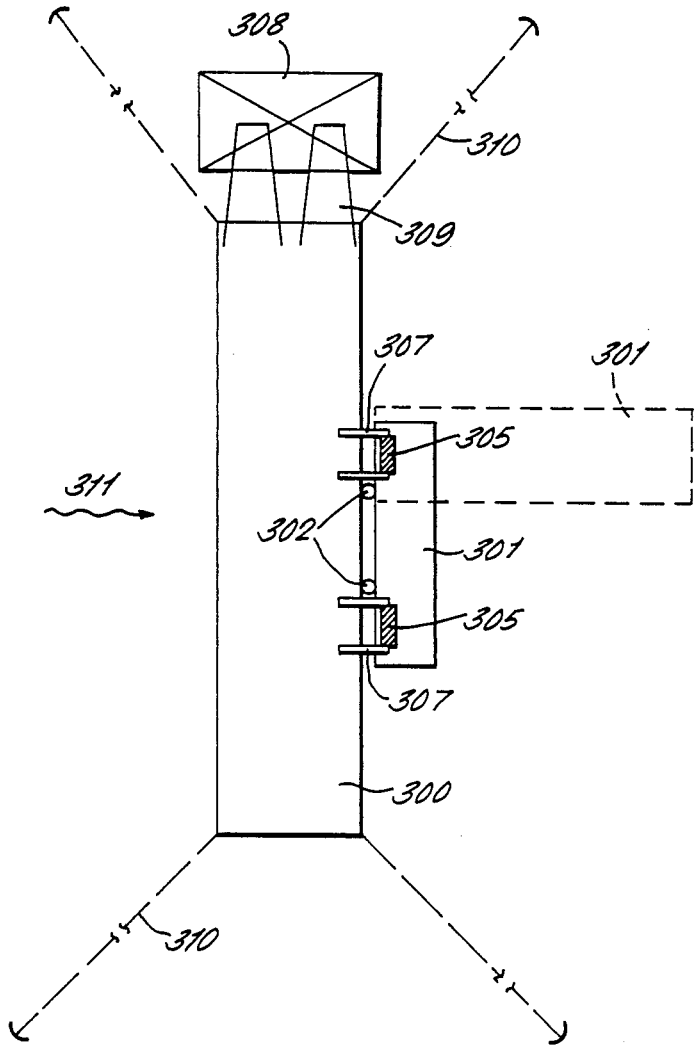

In FIGS. 12 and 13 there is seen a stabilization system for a crane vessel 300 using an assisting vessel 301. Fenders 302 are interposed between the vessels 300 and 301. The assisting vessel 301 has water ballast 303 and counter ballast 304. Clump weights 305 are hung by tension members 306, e.g. chains, from jibs, booms, derricks or the like 307 on the crane vessel 300. FIG. 13 shows the crane vessel 300 being used to transfer a module 308 using shearlegs 309. Additional tugger lines and/or mooring lines 301 may be provided for the crane vessel 300. Tension in the tension members 306 may be adjusted by means of winches and/or by ballasting-/deballasting of the assist vessel 301. The stabilization system is able to control vessel motions induced by beam waves, indicated by arrow 311, because there is an effective broadening of the beam of the crane vessel 300.

The Assisting vessel 301 may be positioned in head waves with its stern connected to the vessel 300, as is shown in dotted lines in FIG. 13, for reduction of vessel motions.

Figure 14:
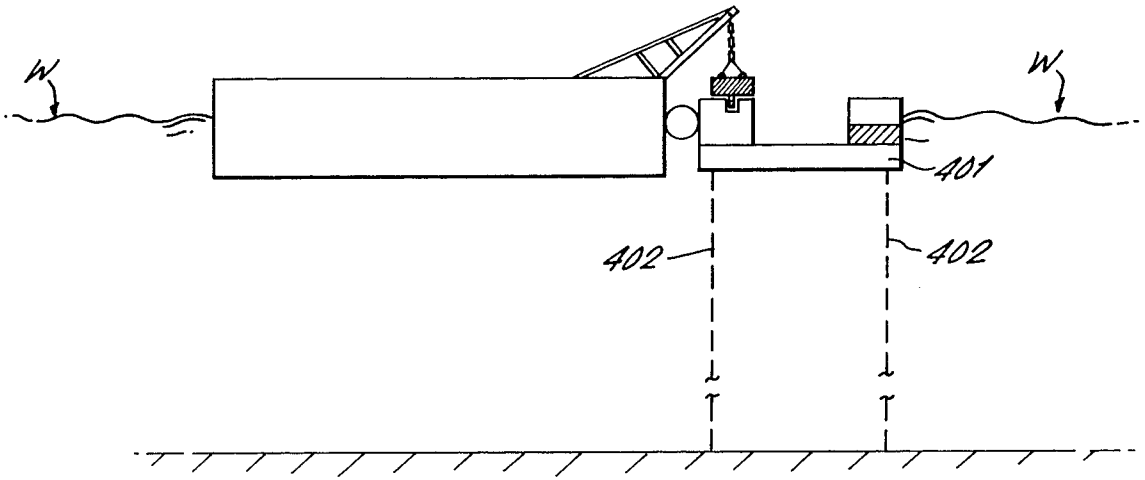
FIGS. 14 and 15 show alternative forms of the stabilization system of FIGS. 12 and 13.

In FIG. 14, the same principle is used with an assisting vessel 401 which is anchored by tension members 402 to the sea bed.

Figure 15:
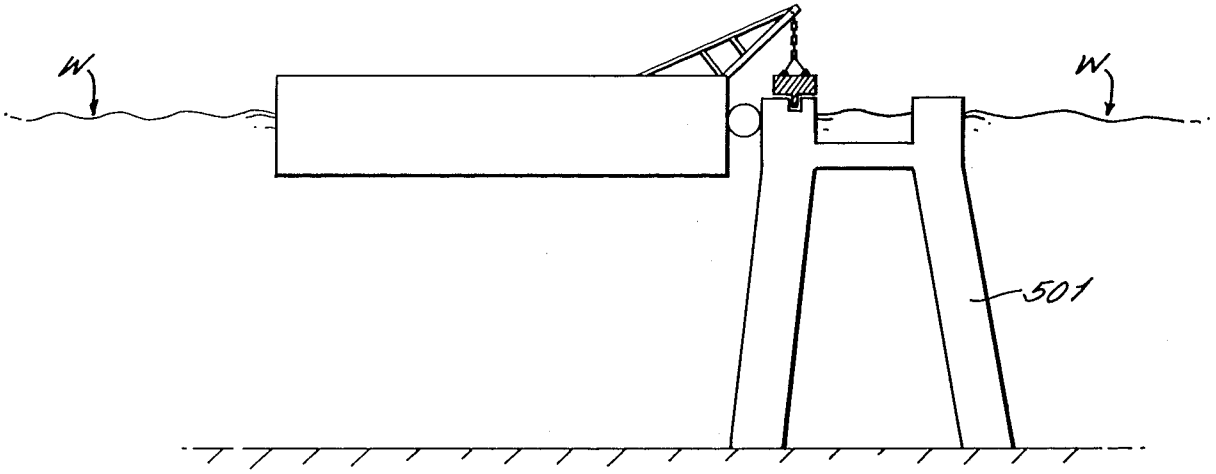

In FIG. 15, the same principle is again used, but here the "assisting vessel" is a fixed structure 501 on the sea bed.

What I claim is:

1. A method of stabilizing a vessel relative to a body remote from said vessel, which method comprises the steps of applying to the vessel a vertical force such as to maintain the vessel in an equilibrium position which is spaced vertically from the normal floating position of the vessel, in which the vertical force comprises a limited vertical force applying means acting on the vessel in one vertical direction and a flexible tension member applying tension to the vessel or said limited force applying means in the opposite vertical direction, arranging for the tension member to have a tension less than the maximum force of said limited vertical force applying means in said equilibrium position of the vessel whereby movement of the vesel in either vertical direction from said equilibrium position gives rise to a change in said vertical force applied to the vessel in a sense tending to return the vessel to its equilibrium position, and horizontally locating said limited vertical force applying means with respect to the vessel or the body even when vertical movement of the vessel is such that said vertical force applied to said vessel is at its limit.

2. A method as claimed in claim 1 wherein said limited vertical force applying means comprises a weight resting on a surface of the body or the vessel.

3. A method as claimed in claim 1 wherein the limited vertical force applying means comprises a float pushing up on a surface of the body or the vessel.

4. A method as claimed in claim 2 and further including the step of providing means for adjusting the vertical position of said weight relative to said surface.

5. A method as claimed in claim 2 and further including the step of providing means for absorbing impacts between said weight and said surface.

6. A method as claimed in claim 3 and further including the step of providing means for adjusting the vertical position of said float relative to said surface.

7. A method as claimed in claim 3 and further including the step of providing means for absorbing impacts between said float and said surface.

8. A method as claimed in claim 3 including the step of providing a plurality of said limited force applying means and said surfaces to provide said vertical forces to act on the vessel at horizontally spaced locations on the vessel.

9. Apparatus for stabilizing a vessel relative to a body remote from said vessel, said apparatus comprising means to apply a vertical force to the vessel such as to maintain the vessel in an equilibrium position which is spaced vertically from the normal floating position of the vessel, said means comprising a limited vertical force applying means acting on the vessel in one vertical direction and a flexible tension member applying tension to the vessel or said limited force applying means in the opposite vertical direction, the tension member being arranged to have a tension less than the maximum force of said limited vertical force applying means in said equilibrium position of the vessel whereby movement of the vessel in either vertical direction from said equilibrium position gives rise to a change in said vertical force applied to the vessel in a sense tending to return the vessel to its equilibrium position, means being provided for horizontally locating said limited vertical force applying means with respect to the vessel or the body even when vertical movement of the vessel is such that said vertical force applied to said vessel is at its limit.

10. Apparatus as claimed in claim 9 wherein said limited vertical force applying means comprises a weight resting on a surface of the body or the vessel.

11. Apparatus as claimed in claim 9 wherein the limited vertical force applying means comprises a float pushing up on a surface of the body or the vessel.

12. Apparatus as claimed in claim 10 and including means for adjusting the vertical position of said weight relative to said surface.

13. Apparatus as claimed in claim 10 and including means for absorbing impacts between said weight and said surface.

14. Apparatus as claimed in claim 10 including a plurality of said limited force applying means and said surfaces to provide said vertical forces to act on the vessel at horizontally spaced locations on the vessel.

15. Apparatus as claimed in claim 11 and including means for adjusting the vertical position of said float relative to said surface.

16. Apparatus as claimed in claim 11 and including means for absorbing impacts between said float and said surface.

17. Apparatus as claimed in claim 12 wherein said adjusting means is provided by ballasting or deballasting the vessel.

18. Apparatus as claimed in claim 12 wherein said adjusting means comprises means for adjusting the length of said tension member.

* * * * *